United States Patent [19]

DeLong et al.

[11] Patent Number: 4,746,342

[45] Date of Patent: May 24, 1988

[54] RECOVERY OF NGL'S AND REJECTION OF $N_2$ FROM NATURAL GAS

[75] Inventors: Bradley W. DeLong; Michael L. Gray, both of Bartlesville, Okla.

[73] Assignee: Phillips Petroleum Company, Bartlesville, Okla.

[21] Appl. No.: 71,839

[22] Filed: Jul. 10, 1987

Related U.S. Application Data

[63] Continuation of Ser. No. 802,493, Nov. 27, 1985, abandoned.

[51] Int. Cl.[4] ..... F25J 3/02

[52] U.S. Cl. ..... 62/24; 62/32; 62/39; 62/42

[58] Field of Search ..... 62/24, 27, 32, 34, 36, 62/38, 39, 42

[56] References Cited

U.S. PATENT DOCUMENTS

| | | | |
|---|---|---|---|
| 2,265,558 | 12/1941 | Ward et al. | 62/23 |
| 2,581,088 | 1/1952 | Etherington et al. | 62/23 |
| 3,205,669 | 9/1965 | Grossmann | 62/23 |
| 3,293,869 | 12/1966 | Karbosky et al. | 62/23 |
| 3,559,417 | 2/1971 | Hoffman | 62/24 |
| 3,596,472 | 8/1971 | Streich | 62/28 |
| 3,721,099 | 3/1973 | Forg et al. | 62/29 |
| 3,874,184 | 1/1975 | Harper et al. | 62/28 |
| 4,155,729 | 5/1979 | Gray et al. | 62/18 |
| 4,203,741 | 5/1980 | Bellinger et al. | 62/24 |
| 4,203,742 | 5/1980 | Agnihotri | 62/24 |
| 4,225,329 | 9/1980 | Bailey et al. | 62/24 |
| 4,235,613 | 11/1980 | Castoe et al. | 62/17 |
| 4,311,496 | 1/1982 | Fabian | 62/17 |
| 4,451,275 | 5/1984 | Vines et al. | 62/28 |
| 4,486,209 | 12/1984 | Fabbri et al. | 62/18 |
| 4,496,381 | 1/1985 | Norenburg | 62/30 |

*Primary Examiner*—Ronald C. Capossela

*Attorney, Agent, or Firm*—Williams, Phillips & Umphlett

[57] ABSTRACT

A super-pressured, sub-cooled feed gas, predominating in methane and containing significant amounts of ethane and higher hydrocarbons and nitrogen, is separated by passing the feed gas through at least one separation step to separate a vapor phase and a liquid phase, fractionating the liquid phase to recover ethane and higher hydrocarbons as a liquid and a pipeline gas as a vapor phase product, the vapor phase from the separation step is then sequentially fractionated in second, third and fourth fractionation steps to produce liquid phase from the second fractionation step, which is recycled to the first fractionation step as a reflux, a liquid phase from the third fractionation step which is recovered as a product pipeline gas, a liquid phase from the fourth fractionation step which is recovered as an in-plant fuel and a vapor phase from the fourth fractionation step which is vented to the atmosphere as substantially pure nitrogen. The vapor phase from the first fractionation step and the liquid phases from the third and fourth fractionation step and the vapor from the fourth fractionation step are passed in indirect heat exchange with portions of the feed gas to cool the same and portions of the vapor phase from the separation step, the second fractionation step and the third fractionation step are utilized in reboilers to heat the second, third and fourth fractionation steps.

13 Claims, 2 Drawing Sheets

RECOVERY OF NGL'S AND REJECTION OF $N_2$ FROM NATURAL GAS

BACKGROUND OF THE INVENTION

This is a continuation of Application Ser. No. 802,493 filed Nov. 27, 1985 now abandoned.

The present invention relates to a process for the rejection of nitrogen from a gas predominating in methane and containing significant amounts of nitrogen, and the separation of natural gas liquids and the rejection of nitrogen from a natural gas stream predominating in methane and containing significant amounts of natural gas liquids and nitrogen.

While most natural gas predominates in methane, it can also contain significant amounts of $C_2$, $C_3$, $C_4$, $C_5$ and $C_6$ and higher molecular weight hydrocarbons. Where the gas is to be used as a fuel, the $C_2$ and higher molecular weight hydrocarbons are generally removed, to the extent practical, since these materials are generally of greater value for purposes other than as a gaseous heating fuel. For example, $C_2$, $C_3$ and $C_4$ hydrocarbons are valuable chemical intermediates and the $C_3$ and $C_4$ hydrocarbons are of greater value when separated and utilized as a liquified petroleum gas (LPG). $C_5$ and higher molecular weight hydrocarbons increase the heating value of natural gas, but are normally removed, since they are valuable as blending stocks for motor fuels and for other purposes. In addition, failure to remove $C_5$ and heavier hydrocarbons at an early stage in the separation process can cause freezing problems in later stages of the process. In addition to these useful components, natural gas will, in most cases, also contain significant amounts of acid gases, such as $CO_2$ and $H_2S$, water and $N_2$, all of which are considered impurities which reduce the heating value of the natural gas, cause other problems and, to the extent possible, are in most instances removed from rich, methane product gas, which, of course, is sold as a heating fuel.

Natural gas feeds, as removed from producing wells and passed to gas separating or processing plants, are normally at atmospheric temperature and a pressure significantly above atmospheric pressure. It is customary to remove acid gases such as $CO_2$ and $H_2S$ and, thereafter, pass the gas through a dehydration system to remove the water. At this stage, the $N_2$ is still in the gas but is an inert diluent or contaminated which does not affect the separation process but is preferably removed in order to increase the heating value of the product fuel gas. At this point the gas is cooled by passing the same through one or more cooling stages, at successively lower temperatures. In such cooling states the gas is generally passed in indirect heat exchange with suitable refrigerants. Such refrigerants include propane or propylene and ethane or ethylene. While propane and ethane are generally recovered from the natural gas as a product, the use of these materials, as refrigerants in the process constitutes and uneconomic use of high value saleable products. Refrigerants such as propylene and ethylene are not normally produced as products in a gas processing plant but are instead products produced in refineries and chemical plants. Accordingly, the use of these materials as refrigerants represents an even higher cost alternative. Consequently, it would be highly desirable if the use of such refrigerants could be eliminated. The feed gas is generally expanded through one or more stages to aid in both separation and cooling and the cooling is also aided by indirect heat exchange with process products. While the cooling capabilities of process product streams result in substantial improvements in the economics of a gas processing system, other process streams also have cooling potential and conventional processes do not take full advantage of the cooling capabilities of these streams. As a result, it would also be highly desirable if the cooling capabilities of other process streams could be utilized to further improve the economics.

These and other objects and advantages of the present invention will be apparent from the following description.

SUMMARY OF THE INVENTION

It is therefore an object of the present invention to provide an improved process for separating nitrogen from a gas stream containing nitrogen, and natural gas liquids and nitrogen from a natural gas stream, which overcomes the above-mentioned and other problems of the prior art. A further object of the present invention is to provide an improved process for the separation of natural gas liquids and nitrogen from a natural gas stream which increases the heating value and volume of saleable heating gas. Another object of the present invention is to provide an improved process for the separation of natural gas liquids and nitrogen from a natural gas stream which decreases the volume of nitrogen-enriched gas handled and utilized as an in-plant fuel. Another and further object of the present invention is to provide an improved process for the separation of natural gas liquids and nitrogen from a natural gas stream which substantially reduces the methane content of the separated nitrogen and, thus, makes it economically and environmentally practical to vent such gas to the atmosphere. Yet another object of the present invention is to provide an improved process for the separation of natural gas liquids and nitrogen from a natural gas stream which produces a nitrogen-enriched gas having substantially decreased amounts of methane and, thus, can be vented to the atmosphere, while at the same time increasing the heating value and volume of saleable heating gas, decreasing the volume of nitrogen-containing gas utilized as an in-plant fuel and increasing the heating value of such in-plant fuel.

To remove the nitrogen as a near-pure product requires considerable energy, in the form of either external refrigeration or feed gas expansion. A less energy-intensive method of nitrogen removal is to produce a nitrogen-enriched stream having a heating value too low for sale as a domestic or industrial fuel, but suitable for use as an in-plant fuel. However, the quantity of nitrogen to be removed may require producing more low BTU fuel. This excess product thus represents a significant loss to the extent that its value is too low to transport to another location for use, yet has too high a value and thus represents a significant loss if it is simply disposed of. The only practical method of disposing of this excess low value fuel is to vent the same to the atmosphere. However, the high methane content of a gas thus vented not only creates hazards, but causes air pollution problems. It would, therefore, also be desirable if more of the methane content could be transferred to saleable pipeline gas, thus reducing the amount of low heating value fuel produced and at the same time increasing the volume of saleable pipe line product. In addition, it would be highly desirable if a substantially pure nitrogen stream could be recovered which could be vented to the atmosphere without creating hazards and air pollution or recovered as a saleable product.

Another object of the present invention is to provide an improved process for a separation of natural gas liquids and nitrogen from a natural gas stream, which eliminates the necessity of using external refrigerants. A further object of the present invention is to provide an improved process for the separation of natural gas liquids and nitrogen from a natural gas stream which utilizes a portion of the feed gas as a cooling medium and thus eliminates the necessity of utilizing external refrigerants. Another and further object of the present invention is to provide an improved process for the separation of natural gas liquids and nitrogen from a natural gas stream which expands a portion of the feed gas, utilizes the same to aid in the cooling of the gas stream and is then recycled back to the feed gas. A still further object of the present invention is to provide an improved process for the separation of natural gas liquids and nitrogen from a natural gas stream which utilizes a portion of the feed gas as a cooling medium in place of external refrigerants and integrates this use of a portion of the feed gas with indirect heat exchange with products of the process.

In accordance with one embodiment of the present invention, a gas, predominating in methane and containing significant amounts of nitrogen, is subjected to three sequential fractionation stages to produce a rich methane gas, for use as a domestic and industrial fuel, in a first and second stages and a lean methane gas, for use as an in-plant fuel, in a third stage. In another embodiment, a compressed and cooled natural gas stream is passed through at least one expansion-separation step, under conditions to separate a vapor phase containing substantially all of the nitrogen, and a liquid phase. The liquid phase is fractionated, in a first fractionation step, to separate a vapor phase predominating in methane and a product liquid phase of ethane and higher hydrocarbons. The vapor phase from the expansion-separation is further fractionated, in a second fractionation step, to produce a vapor phase enriched in nitrogen and methane and a liquid phase, which is recycled to the first fractionation step as a reflux. The vapor phase from the second fractionation step is further fractionated, in a third fractionation step, to produce an overhead of nitrogen-enriched gas and a liquid phase predominating in methane, which can be combined with the vapor phase from the first fractionation step as a saleable heating fuel. In a further embodiment of the present invention, the vapor phase from the third fractionation step is further fractionated, in a fourth fractionation step, to produce a vapor phase, predominating in nitrogen and which can be vented to the atmosphere, and a liquid phase, predominating in methane which is suitable for use as a low heating value fuel. In yet another embodiment of the present invention, a portion of the feed gas which has been preliminarily cooled is expanded, utilized as a cooling medium for the feed gas and is then recycled back to the feed gas prior to compression.

BRIEF DESCRIPTION OF THE DRAWING

The single FIGURE of drawings is a schematic flow diagram including all embodiments of the present invention. The FIGURE of the drawings has been separated into sheets A and B to facilitate viewing and understanding.

DESCRIPTION OF THE PREFERRED EMBODIMENTS

Figure 1A:
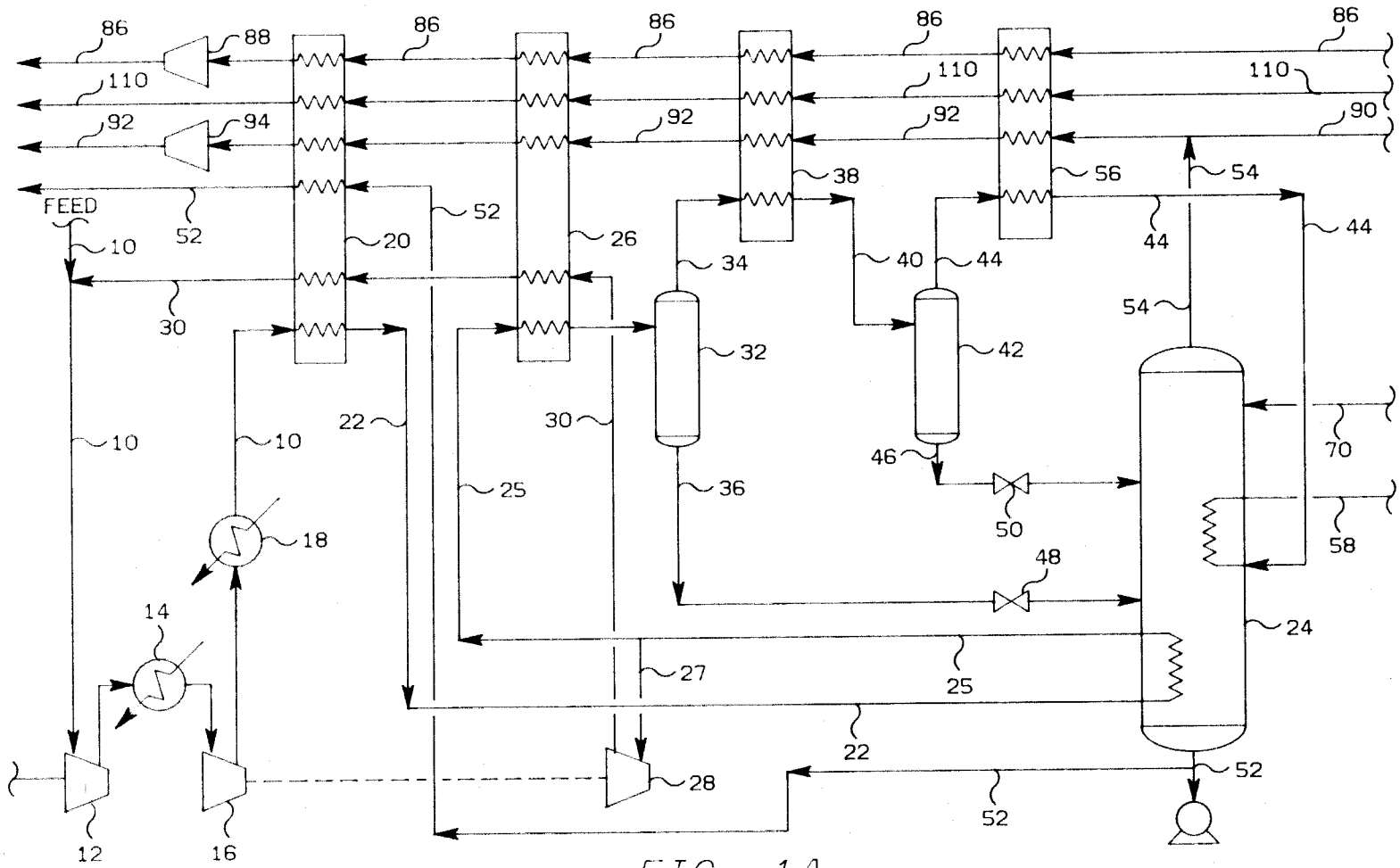
Figure 1B:
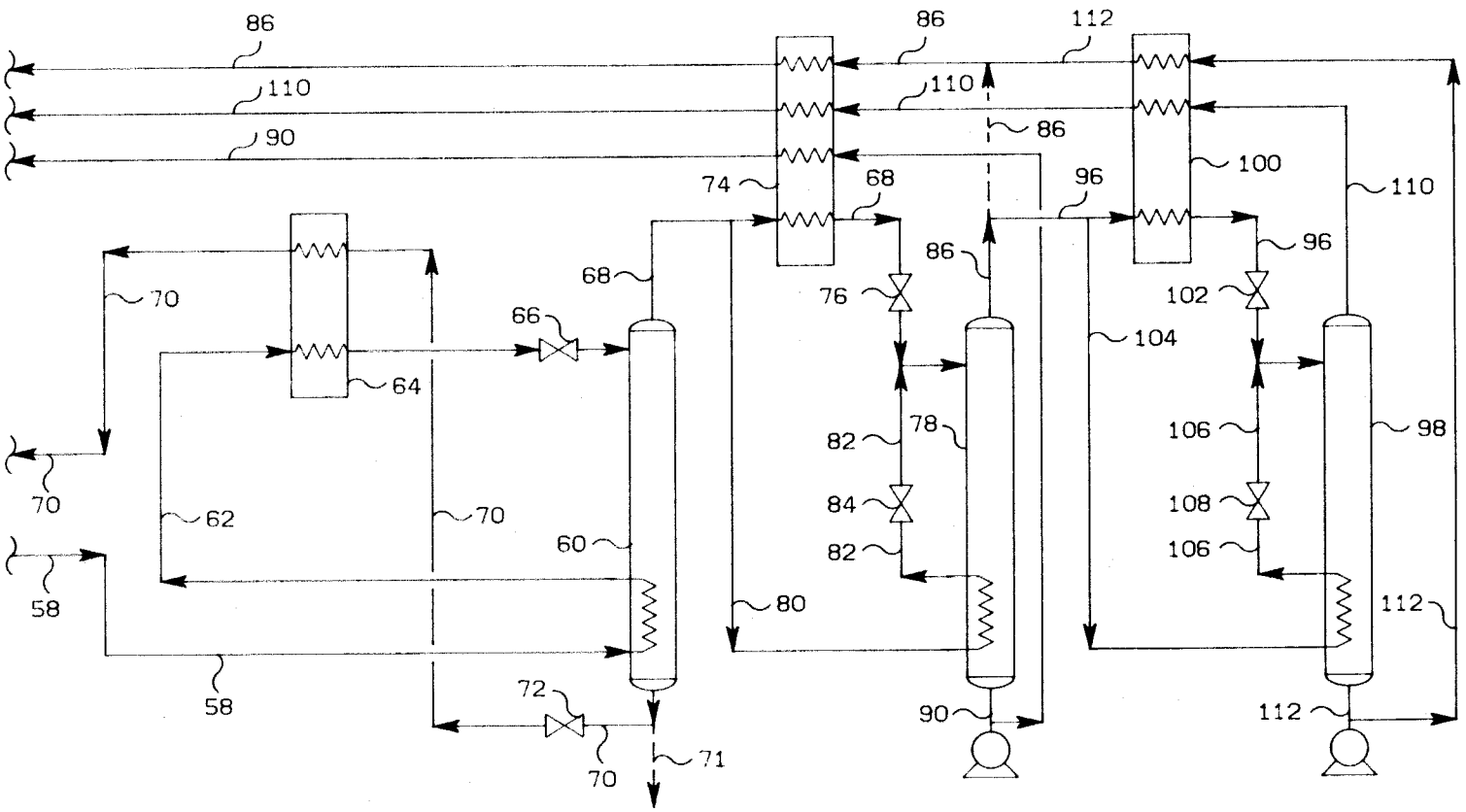

The nature, objects and advantages of the present invention will he apparent from the following description when read in conjunction with the drawing.

In the description with reference to the drawing, certain characteristics of effluent streams are referred to, assuming a feed gas of the following composition in mols per day:

| | |
|---|---|
| $N_2$ | 37,436 |
| $C_1$ | 321,901 |
| $C_2$ | 23,837 |
| $C_3$ | 8,578 |
| $iC_4$ | 672 |
| $nC_4$ | 1,739 |
| $iC_5$ | 356 |
| $nC_5$ | 435 |
| $C_6+$ | 356 |
| | 395,310 |

Natural gas feed 10, contains significant amounts of ethane and higher molecular weight hydrocarbons and nitrogen, in addition to the predominating methane. In accordance with conventional practice, acid gases such as carbon dioxide and hydrogen sulfide and water have been previously removed. The natural gas feed will generally have a temperature near atmospheric temperature, for example about 70° to 90° F. and a pressure above atmospheric pressure, for example 193 PSIA. This gas is further compressed several fold, in compressor 12, cooled in inner cooler 14, compressed in booster compressor 16 and again cooled in compressor discharge cooler 18. As a result of such compression, the gas pressure is raised to about 760 to 1000 PSIA. Coolers 14 and 18 are for example, water cooled indirect heat exchangers. Further cooling is affected by indirect heat exchange with process products, as hereinafter described, in heat exchanger 20. This preliminarily cooled feed gas is then passed through line 22 and utilized as the heating medium in a reboiler adjacent the bottom of demethanizer column 24 (hereinafter referred to and described). The reboiler in this instance, as well as the others referred to hereinafter, is an indirect heat exchange system in which fluids in the column are heated by the external fluid and the external fluid is in turn cooled. For example, a portion of the fluids in the column may be collected from above a trap out tray, passed in indirect heat exchange with the external fluid and then returned to the column at a point below the trap out tray. However, for simplification, the reboilers are shown in the present drawing as a simple heat exchange tube system disposed in the bottom of the tower with the warmer external fluid passing into the bottom and being withdrawn at a higher elevation as a cooler external fluid. Accordingly, the natural gas feed after passing through the reboiler at the bottom of column 24 is then passed through line 25 and is still further cooled by passing the same in indirect heat exchange with products of the process in heat exchanger 26. From heat exchanger 26, the natural gas stream is passed to at least one vapor liquid separator hereinafter described.

In accordance with one aspect of the present invention, utilization of external refrigerants is eliminated by withdrawing a portion of the preliminarily cooled feed gas from line 25 and utilizing the same as a substitute for such external refrigerants. Specifically, a portion of the natural gas feed (for example about 22%) is withdrawn from line 25 through line 27 is epxanded in turbo expander 28, is passed through line 30, thence through indirect heat exchanger 26 and indirect heat exchanger 20 and recombined or recycled back to the initial feed gas stream 10. In addition to thus utilizing a portion of the natural gas feed as a substitute for external refrigerants, this procedure has the additional advantage that expander 28 may be utilized to operate the booster compressor 16 for compression of the gas. It will, however, be necessary to drive compressor 12 by external means.

During the course of the passage of the main gas stream through heat exchangers 20 and 26 and the reboiler in column 24, the gas stream is partially condensed and passed through line 25 to at least one vapor-liquid separator. In the present instance, the separation includes two stages of separation. First stage separator 32 separates a vapor phase and discharges the same through line 34 and a liquid phase, which is discharged through line 36. The vapor phase is further cooled by passage through heat exchanger 38 where it is cooled by indirect heat exchange with products of the process. Further condensation of liquids occurs in heat exchanger 38 and the partially condensed stream is then passed through line 40 to the second separator 42. In second separator 42, a vapor is again separated from a liquid and thereafter vapor and liquid are discharged through lines 44 and 46, respectively. The liquids discharged from separators 32 and 42 are preferably controlled by liquid level control valves 48 and 50, respectively. Liquids discharged from first separator 32 and from second separator 42 are passed through lines 36 and 46, respectively to a first fractionation column 24, usually referred to as a demethanizer, where it is heated and a portion thereof vaporized. As previously indicated, at least part of the heating of column 24 is supplied by the reboiler adjacent the bottom of the column. The heat supplied to column 24 will generally be sufficient at the existing pressure to provide substantially complete separation of methane from ethane and higher molecular weight hydrocarbons. Consequently, it should be noted at this point that the warmer liquid from the first separator 32 is fed to column 24 at a lowermost location, whereas the cooler liquid from second separator 42 is introduced to column 24 at a higher location. As a result, separation is improved by the cooler liquid passing downwardly in contact with the warmer rising vapors. It should also be noted at this point that the cooling of the gases fed to separators 32 and 42 is such that, at the existing pressure, the vapor stream 44 from second separator 42 or the vapor stream from a single separator, where a single separator is used, is such that this overhead stream contains most of the nitrogen. This of course can be accomplished by retaining substantial amounts of methane in the vapor stream. Consequently, liquid streams to column 24 will contain very little nitrogen, preferably less than about 1.0 mole percent of the amount originally present in the feed. As a result, the liquid bottoms product of ethane and higher hydrocarbons from column 24 has a purity in the neighborhood of about 96 mole percent with the remainder being methane. This liquid product is pumped through line 52. For example, where separation is desired, the product can be further fractionated, for example, in a deethanizer, a debutanizer and a depentanizer to obtain individual fractions of $C_2$, $C_3$, $C_4$, $C_5$ and $C_6$ and higher hydrocarbons. Stream 52 is still sufficiently cool that it may be utilized to provide some of the cooling for the feed gas stream by passing the same through heat exchanger 20 prior to use or further separation. In like manner, a vapor stream through line 54, from column 24, which contains less than about 2.3 mole percent of nitrogen and a small amount of ethane, is produced. Consequently, this gas is suitable for use as a saleable heating gas, having a substantially higher heating value than that conventionally produced. The overhead vapor from second separator 42 contains about 98 mole % of the nitrogen originally present in the feed. This vapor stream is passed through indirect heat exchanger 56, in indirect heat exchange with products of the process to further cool the same and is then passed through an intermediate reboiler of column 24. From the intermediate reboiler of claim 24, the vapor is passed through line 58 and thence through a bottom reboiler in the second fractionation column 60. From the reboiler of column 60, the vapor passes through line 62, thence in indirect heat exchange through heat exchanger 64 for further cooling. In addition to the additional cooling provided by the intermediate reboiler of column 24, the bottom reboiler of column 60 and heat exchanger 64 further cooling and separation is aided by passing the stream through pressure controlled expansion valve 66. As the result of this cooling and throttling or expansion, the main gas stream will be still further cooled. Second fractionation column 60 would normally be referred to as a nitrogen column and the overhead therefrom would be a lean methane gas of low heating value, suitable for in-plant use, whereas the bottoms product would be a saleable fuel gas product. However in accordance with the present invention, column 60 is operated so as to retain more methane in the overhead and is therefore referred to herein as a nitrogen rejection or enrichment column. The vapor phase overhead from column 60 is discharged through line 68. The liquid product separated in column 60 is discharged through line 70, utilized as a cooling medium in heat exchanger 64 for cooling the feed to column 60 and is recycled to column 24 to act as a reflux, which substantially improves separation of methane from ethane and higher hydrocarbons in column 24. Liquid discharged from column 60 is preferably controlled by level control valve 72, in accordance with the liquid level in column 60.

Further, in accordance with the present invention, the vapor stream from column 60 is cooled by passage through heat exchanger 74 in indirect heat exchange with products of the process. The major portion of the overhead through line 68 and passing through heat exchanger 74 is further cooled and a portion thereof condensed by passing the same through pressure controlled throttle or expansion valve 76 and thence to a third fractionation column 78. Third fractionation column 78 is referred to herein as a fuel column. A portion of the overhead from fractionation column 60 may be passed through line 80 and utilized as a source of heat in the bottom reboiler of fractionation column 78. This portion of the overhead then passes from the reboiler through line 82 where it is combined with the feed to column 78, passing through line 68. This portion of the overhead from column 60 is also further cooled and a portion thereof condensed by passage through pressure control throttle or expansion valve 84. Column 78 is operated under conditions to produce a high nitrogen content, low heating value fuel suitable for use as an in-plant fuel which is discharged through line 86. This fuel gas in accordance with the present invention is significantly reduced in volume by following the process of the present invention described up to this point. The fuel gas from column 78 is then passed through heat exchangers 74, 56, 38, 26 and 20 where it provides a substantial part of the cooling for the main gas stream. If necessary or desirable, this fuel gas may be compressed in compressor 88. The bottoms product from column 78, referred to as the fuel column is pumped through line 90, is passed through heat exchanger 74 to provide part of the cooling for the main gas stream and thence is combined with the overhead from column 24. After being combined with the overhead from column 24, the combined stream 92 passes through heat exchangers 56, 38, 26 and 20. The product passing through line 90 as a bottoms product from column 78 is a high heating value, saleable heating or pipeline gas. This gas stream has a higher volume as well as a higher heating value than that conventionally produced. For example, this gaseous stream would contain about 86 mole percent of methane and about 13 mole percent of nitrogen. However, when combined with the overhead from column 24, which passes through line 54, the resulting residue or pipeline gas in line 92 will contain about 4.7 mole percent of nitrogen and about 94.7 mole percent of methane. This pipeline gas or residue gas may be compressed in compressor 94 for storage or transport.

In a preferred embodiment of the present invention, rather than utilizing the overhead from column 78 directly as an in-plant fuel by passing the same through line 86, this overhead which contains about 35 mole percent of methane and about 65 mole percent of nitrogen is further separated by passing the same through line 96 to a fourth fractionation column 98. The overhead from column 78 passing through line 96 is further cooled and condensed by passage through indirect heat exchanger 100 and pressure control throttle or expansion valve 102. Preferably a portion of the overhead from column 78 is withdrawn through line 104, utilized to supply heat in a bottom reboiler of column 98 and then passed through line 106 and combined with the major portion of the overhead from column 78, passing through line 96 as a feed to column 98. The portion of the overhead from column 78 passing through line 104 is further cooled and partially condensed by passage through the reboiler at the bottom of column 98 and through throttling or expansion valve 108. The overhead vapor from column 98 is a nitrogen-enriched stream, referred to as a nitrogen vent stream and is discharged through line 110; thence, sequentially through heat exchangers 100, 74, 56, 38, 26 and 20. The nitrogen-rich gas may then be vented to the air safely or utilized as a source of essentially pure nitrogen. The overhead from column 98 contains about 55 mole percent of the nitrogen originally in the feed stream. The bottoms product from column 98 is pumped through line 112, through heat exchanger 100 and thence through line 86. In passing through line 86, the bottoms from column 98 sequentially passes through heat exchangers 74, 56, 38, 26 and 20, where it is utilized for cooling portions of the feed gas stream. As previously indicated, this gas stream may be compressed in compressor 88 prior to use. This bottoms product from column 98 has an improved heating value, for example, from 350 BTU/SCF to 863 BTU/SCF, and a substantially decreased nitrogen content. In the example given, it will contain approximately 86 mole percent methane and about 14 mole percent of nitrogen. Thus the in-plant fuel has a higher heating value than conventionally, and, as previously pointed out is of substantially reduced volume compared to conventional processing schemes.

In yet another embodiment of the present invention, a gas predominating in methane and containing significant amounts of nitrogen is treated to produce a rich methane stream, suitable for use as a pipeline gas, a lean methane stream, suitable for use as an in-plant fuel, and a rich nitrogen gas, which may be economically and environmentally vented to the atmosphere or recovered as a saleable nitrogen product. This is accomplished by passing feed gas predominating in methane and containing significant amounts of nitrogen, through line 62 to nitrogen rejection or enrichment column 60, thence to fuel column 78 and finally to nitrogen vent column 98. The liquid bottoms from column 60 discharged through line 70 can be recovered as a rich methane pipeline gas, liquid from column 98 discharged through line 112 can be recovered as a plant fuel, and a nitrogen-rich overhead from column 98 can be vented to the atmosphere or processed to produce saleable nitrogen.

The following table sets forth a calculated example of the yields obtainable, when operating in accordance with the present invention, from the feed gas referred to in the detailed description. The numbers at the heads of the columns of the table refer to flow lines or items of equipment of the drawing.

TABLE I

| Mols | 10 Feed | 30 Feed Recycle | 34 1st HP Sep. Vapor | 36 1st HP Sep. Liquid | 44 2nd HP Sep. Vapor | 46 2nd HP Sep. Liquid | 54 Demeth Overhead Product | 52 NGL Product |
|---|---|---|---|---|---|---|---|---|
| $N_2$ | 37,436 | 8,236 | 8,236 | 401 | 36,729 | 306 | 6,080 | |
| $C_1$ | 321,901 | 70,818 | 70,818 | 10,748 | 304,002 | 7,151 | 251,274 | 1,042 |
| $C_2$ | 23,837 | 5,244 | 5,244 | 4,404 | 17,113 | 2,320 | 1,815 | 21,579 |
| $C_3$ | 8,578 | 1,887 | 1,887 | 4,005 | 3,083 | 1,490 | 32 | 8,529 |
| $iC_4$ | 672 | 148 | 148 | 470 | 89 | 113 | | 672 |
| $nC_4$ | 1,739 | 383 | 383 | 1,335 | 151 | 253 | | 1,739 |
| $C_5$ | 356 | 78 | 78 | 323 | 5 | 28 | | 356 |
| $nC_5$ | 435 | 96 | 96 | 401 | 5 | 29 | | 435 |
| $C_6$+ | 356 | 78 | 78 | 347 | 1 | 8 | | |
| | 395,310 | 86,968 | 86,968 | 22,434 | 361,178 | 11,698 | 259,201 | 34,708 |
| Mol.% | | | | | | 28 + 36 | | |
| $N_2$ of Orig. | | | | | 98.1+ | <1.0− | | |
| $CH_4$ of Orig. | | | | | 94.4+ | 5.6− | 78.1 | |
| NGL ($C_2$+) | | | | | | | | 96.0+ |
| $N_2$ | | | | | | | 2.3+ | |
| $CH_4$ | | | | | | | 96.9+ | |

TABLE I-continued

| Mols | 68 $N_2$ Enrichment Col. Overhead | 86 Fuel Col. Overhead | 90 Fuel Col. Bottoms | 54 + 90 Residue (Pipeline) Gas | 110 $N_2$ Vent Col. Overhead | 112 $N_2$ Vent Col. Bottoms (Fuel Gas) |
|---|---|---|---|---|---|---|
| $N_2$ | 31,356 | 22,294 | 9,062 | 15,142 | 20,385 | 1,909 |
| $C_1$ | 69,586 | 11,817 | 57,768 | 309,042 | 523 | 11,294 |
| $C_2$ | 442 | 2 | 441 | 2,256 | | |
| $C_3$ | 17 | | 17 | 49 | | |
| $iC_4$ | | | | | | |
| $nC_4$ | | | | | | |
| $iC_5$ | | | | | | |
| $nC_5$ | | | | | | |
| $C_6$+ | | | | | | |
| | 101,401 | 34,113 | 67,288 | 326,489 | 20,908 | 13,205 |
| Mol.% | | | | | | |
| $N_2$ of Orig. | | | | 40.4+ | 54.5− | 5.1− |
| $CH_4$ of Orig. | | | | 96.0+ | 0.2− | 3.5+ |
| NGL ($C_2$+) | | | | | | |
| $N_2$ | | 65.4 | 13.5 | 4.7 | 97.5− | 14.4+ |
| $CH_4$ | | 34.6 | 85.8 | 94.7 | 2.5+ | 85.5+ |

While specific materials, modes of operation and items of equipment have been described herein, it is to be understood that these specific recitals are by way of illustration only and are not to be considered limiting.

That which is claimed is:

1. A method of separating a super-pressured subcooled feed gas, predominating in methane and containing significant amounts of ethane and higher hydrocarbons and nitrogen, said feed gas being at a pressure substantially above atmospheric pressure and a temperature substantially below atmospheric temperature sufficient to form a vapor phase and liquid phase, comprising:

(a) separating said feed gas, in at least one separation step, to produce a methane- and nitrogen-enriched first vapor phase and an ethane and higher hydrocarbon-enriched first liquid phase;

(b) fractionating said first liquid phase, in a first fractionation zone, under conditions sufficient to produce a product, methane-enriched, second vapor phase and a product, ethane and higher hydrocarbon-enriched, second liquid phase;

(c) fractionating said first vapor phase, in a second fractionation zone, under conditions sufficient to produce a nitrogen-enriched, third vapor phase and a methane-enriched, third liquid phase; and (d) fractionating said third vapor phase, in a third fractionation zone, under conditions sufficient to produce a product, nitrogen-enriched, fourth vapor phase and a product, methane-enriched fourth liquid phase.

2. A method in accordance with claim 1 wherein said third liquid phase is introduced into said first fractionation zone as a reflux therefor.

3. A method in accordance with claim 2 wherein said third liquid phase is passed in indirect heat exchange with said first vapor phase before said third liquid phase is thus introduced into said first fractionation zone as reflux therefor.

4. A method in accordance with claim 3 wherein:

(a) said fourth vapor phase and said fourth liquid phase are passed in indirect heat exchange with said third vapor phase; and (b) said fourth vapor phase, said fourth liquid phase and said second vapor phase are passed in indirect heat exchange with said first vapor phase and thereafter with said feed gas to cool said third vapor phase, said first vapor phase and said feed gas.

5. A method in accordance with claim 1 wherein:

(a) said fourth vapor phase and said fourth liquid phase are passed in indirect heat exchange with said third vapor phase; and (b) said fourth vapor phase, said fourth liquid phase and said second vapor phase are passed in indirect heat exchange with said first vapor phase and thereafter with said feed gas to cool said third vapor phase, said first vapor phase and said feed gas.

6. A method in accordance with claim 1 wherein prior to separating said feed gas, said feed gas is compressed in at least one compression stage, a portion of said feed gas is thereafter withdrawn, the thus withdrawn portion of said feed gas is passed through at least one expansion stage where it is reduced in pressure by an amount sufficient to significantly reduce the temperature thereof, the thus expanded withdrawn portion of said feed gas, whose temperature has been reduced, is passed in indirect heat exchange with said feed gas in at least one cooling stage, to further cool said feed gas, and then said expanded withdrawn portion of said feed gas, which has thus been passed in indirect heat exchange with said feed gas, is recycled and recombined with said feed gas prior to said at least one compression stage.

7. A method in accordance with claim 6 wherein:

(a) said fourth liquid phase and said fourth vapor phase are passed in indirect heat exchange with said third vapor phase;

(b) said fourth liquid phase, said fourth vapor phase and said second vapor phase are passed in indirect heat exchange with said first vapor phase; and (c) said fourth liquid phase, said fourth vapor phase, said second vapor phase and said expanded withdrawn portion of said feed gas are passed in indirect heat exchange with said feed gas to cool said third vapor phase, said first vapor phase and said feed gas.

8. A method in accordance with claim 6 whereby energy is produced in said at least one expansion stage and said energy is applied to said at least one compression stage, to provide at least part of the energy consumed in said at least one compression stage.

9. A method in accordance with claim 8 wherein said feed gas is cooled in a first cooling stage and thereafter a second cooling stage by passing in indirect heat exchange the thus expanded said withdrawn portion of said feed gas through said second cooling stage and thereafter said first cooling stage.

10. A method in accordance with claim 9 wherein:

(a) said fourth liquid phase and said fourth vapor phase are passed in indirect heat exchange with said third vapor phase;

(b) said fourth liquid phase, said fourth vapor phase and said second vapor phase are passed in indirect heat exchange with said first vapor phase; and (c) said fourth liquid phase, said fourth vapor phase, said second vapor phase and said expanded withdrawn portion of said feed gas are passed through said second cooling stage and thereafter through said first cooling stage in indirect heat exchange with said feed gas to cool said third vapor phase, said first vapor phase and said feed gas.

11. A method in accordance with claim 9 wherein said feed gas is passed in indirect heat exchange through said first cooling stage and thereafter with fluids in said first fractionation zone and thereafter through said second cooling stage.

12. A method in accordance with claim 6 wherein said fourth vapor phase is fractionated in a fourth fractionation zone, under conditions sufficient to produce a product, fifth vapor phase, further enriched in nitrogen and a product, fifth liquid phase further enriched in methane.

13. A method in accordance with claim 12 wherein:

(a) said fifth liquid phase and said fifth vapor phase are passed in indirect heat exchange with said fourth vapor phase;

(b) said fifth liquid phase, said fifth vapor phase and said fourth liquid phase are passed in indirect heat exhange with said third vapor phase;

(c) said fifth liquid phase, said fifth vapor phase, said fourth liquid phase and said second vapor phase are passed in indirect heat exchange with said first vapor phase; and (d) said fifth liquid phase, said fifth vapor phase, said fourth liquid phase, said second vapor phase and said expanded withdrawn portion of said feed gas are passed in indirect heat exchange with said feed gas.

* * * * *